United States Patent [19]

Zeidler

[11] 4,064,656

[45] Dec. 27, 1977

[54] DEVICE FOR BLASTING LARGE AND BULKY WORKPIECES

[75] Inventor: Johannes Zeidler, Reinbek, Germany

[73] Assignee: Alfred Gutmann Gesellschaft fur Maschinenbau, Hamburg, Germany

[21] Appl. No.: 694,142

[22] Filed: June 9, 1976

[30] Foreign Application Priority Data

June 10, 1975 Germany ..... 2525761

[51] Int. Cl.[2] ..... B24C 3/06

[52] U.S. Cl. ..... 51/426; 51/429; 239/165; 239/166; 51/431

[58] Field of Search ..... 51/8 R, 8 C, 9 R, 9 M; 114/222-224; 118/308; 134/172; 239/160, 165, 166, 176, 269

[56] References Cited

U.S. PATENT DOCUMENTS

| | | | |
|---|---|---|---|
| 993,743 | 5/1911 | Wright | 51/8 C |
| 2,450,401 | 9/1948 | Thompson | 51/8 C |
| 3,153,510 | 10/1964 | Brännfors | 239/165 X |
| 3,827,187 | 8/1974 | Yamamoto | 51/9 R |
| 3,833,175 | 9/1974 | Pulk | 239/176 |
| 3,913,836 | 10/1975 | Stevenson | 239/166 |
| 3,951,092 | 4/1976 | Broek | 51/9 M X |

*Primary Examiner*—Gary L. Smith

*Attorney, Agent, or Firm*—Olsen and Stephenson

[57] ABSTRACT

Apparatus for blasting particulate material onto workpieces wherein the workpiece is positioned within an enclosure, and a centrifugal impeller of a conventional type is supported in the enclosure on mobile mounting means for movement in a plurality of directions in such a manner that large surfaces or surfaces of complicated shapes can be blasted. The mobile mounting means and the centrifugal impeller can be operated remotely from outside the enclosure.

3 Claims, 2 Drawing Figures

DEVICE FOR BLASTING LARGE AND BULKY WORKPIECES

BACKGROUND OF THE INVENTION

This invention relates to apparatus for blasting a bulky and large workpiece in an enclosed blasting area with a blasting wheel that is movable in relation to the workpiece.

Conveniently, bulky and large workpieces, such as containers, boilers, bridge beams, nuclear reactor parts, and the like, are cleaned by air operated blasting nozzles, which are operated manually. An operation of this type is not only very laborious, but it is also very inefficient and is very costly from the time standpoint.

To overcome these inadequacies, other types of blasting operations have been attempted. Efforts have been made to blast workpieces in an enclosed blasting room or enclosure, wherein the walls are equipped with many different centrifugal impellers or blasting wheels, which are arranged to encompass the entire workpiece. In blasting rooms of this character, the workpieces have had to be moved in relation to the walls of the rooms and to the blasting wheels. Due to the substantial number of wheels required and due to the fact that the workpieces have had to be moved, it was necessary to provide large rooms and the overall arrangement was costly. It was also difficult in some instances to blast workpieces of different shapes when using the same room or enclosure with the blasting wheels in stationary locations.

Efforts have been made to move a single blasting wheel over a section of a wall or ceiling of a blasting room or enclosure. This was done to cover larger areas of a workpiece with one blasting wheel and required a room or enclosure that was dimensioned in such a way that one wheel would cover the total length of the workpiece. However, this procedure was completely inadequate to provide the desired quality of blasting for many products of large or irregular shape.

SUMMARY OF THE INVENTION

The present invention has overcome the inadequacies of the prior art so that a single blasting wheel can be utilized in a single enclosure to perform the desired blasting operations on workpieces of complicated shapes and which have large surface areas. This is accomplished by locating the blast wheel or centrifugal impeller within the enclosure so that it is movable in a plurality of directions. The apparatus is also constructed and arranged so that it can be controlled from outside the enclosure by suitable electronic or mechanically operated means. Due to the fact that the blasting wheel is mobile, the blasting enclosure need only be as large as is necessary to hold the largest workpiece that it is contemplated will require blasting, While in some instances it may be necessary for very complicated workpieces to use manually operated air blast equipment to finish the blasting operations, the present invention has reduced such requirements to a minimum.

According to a preferred form, the present invention comprises an enclosure within which a workpiece can be positioned, mobile mounting means in the enclosure movable the length thereof on horizontally disposed rails, the mobile mounting means including a carriage arranged to travel on the rails, and a centrifugal impeller or blasting wheel for blasting particulate material onto the workpiece, the centrifugal impeller being supported by the mounting means for travel therewith. The mounting means is operable to move the centrifugal impeller in at least one of several different directions of movement in addition to its travel on the rails.

In the preferred form of the invention, the mounting means includes an articulate arm supported at one end on the carriage, and the centrifugal impeller is supported at the other end of the articulate arm. The arm is extensible and contractible for moving the centrifugal impeller in a generally horizontal plane toward and away from the carriage. The arm is mounted at its inner end on a vertical column on the carriage for vertical movement and also for pivotal movement around a vertical axis. The centrifugal impeller is supported at the outer end of the arm in a yoke that is connected for pivotal movement about a vertical axis and that pivotally supports the centrifugal impeller for pivotal movement about a horizontal axis. Remote control means are provided for operating the centrifugal impeller, and additional remote control means are also provided for operating motor means for actuating the various movable joints or arms of the mounting means for moving the centrifugal impeller.

Other objects of this invention will appear in the following description and appended claims, reference being had to the accompanying drawing forming a part of this specification wherein like reference characters designate corresponding parts in the several views.

DESCRIPTION OF THE PREFERRED EMBODIMENT

Before explaining the present invention in detail, it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Figure 1:
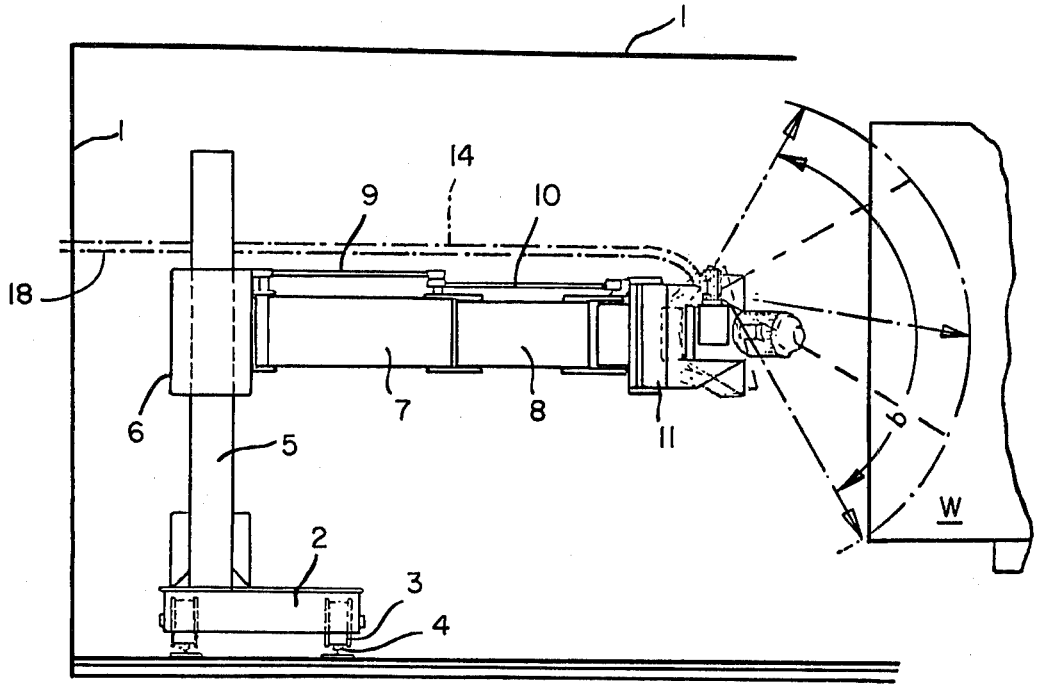
FIG. 1 is a schematic fragmentary front elevational view of apparatus embodying the present invention.

Referring now to the drawing, the invention will be described in greater detail. The apparatus comprising the present invention includes the enclosure 1 in which a workpiece W can be located for carrying out the desired blasting operation. As shown in FIG. 1, the enclosure 1 has top, side and bottom walls. A carriage 2 having wheels 3 is adapted to travel on the rails 4 located on the bottom wall of the enclosure 1. The rails 4 extend the length of the enclosure 1. Extending upward on the carriage 2 is a vertical column 5 on which is mounted a collar assembly 6 suitably arranged to be secured in place or for vertical movement thereon by any suitable vertical actuating means, not shown. Articulate arm means 7, 8 are pivotally connected at one end to the collar assembly 6 and have control linkages 9, 10 associated therewith. The movement of the arm means 7, 8 is accomplished by actuation of hydraulic cylinders 16 and 17, shown in FIG. 2

On the other or free end of the arm 7, 8 is a blasting wheel or centrifugal impeller 12 which is supported within the yoke 11 and which is driven by the motor 13. The pivotal or angular position of centrifugal impeller 12 within the yoke 11 is controlled by a gear transmission 11*a* which is driven to a selected position by a conventional hydraulic motor means 11*b*. Other suitable hydraulic means, not shown, are connected between the yoke 11 and the mounting bracket 8*a* for pivoting the yoke 11 around the vertical axis of pin 8*b*.

The particulate material for the centrifugal impeller 12 is supplied through a flexible conduit 18, shown in phantom lines, and electric power for operating the motor 13 can be supplied by the electric conductor 14, shown in phantom lines. Other control lines, now shown, are associated with the various cylinders and hydraulic apparatus provided for movement of the various arms, joints, and the like so that the components of the mounting means for the centrifugal impeller 12 can be selectively moved. As previously indicated, these controls can be remotely actuated from a location outside of enclosure 1. A drive motor 15, which may be either electrically or hydraulically driven is mounted on the carriage 2 for driving the wheels 3 on the rails 4.

Figure 2:
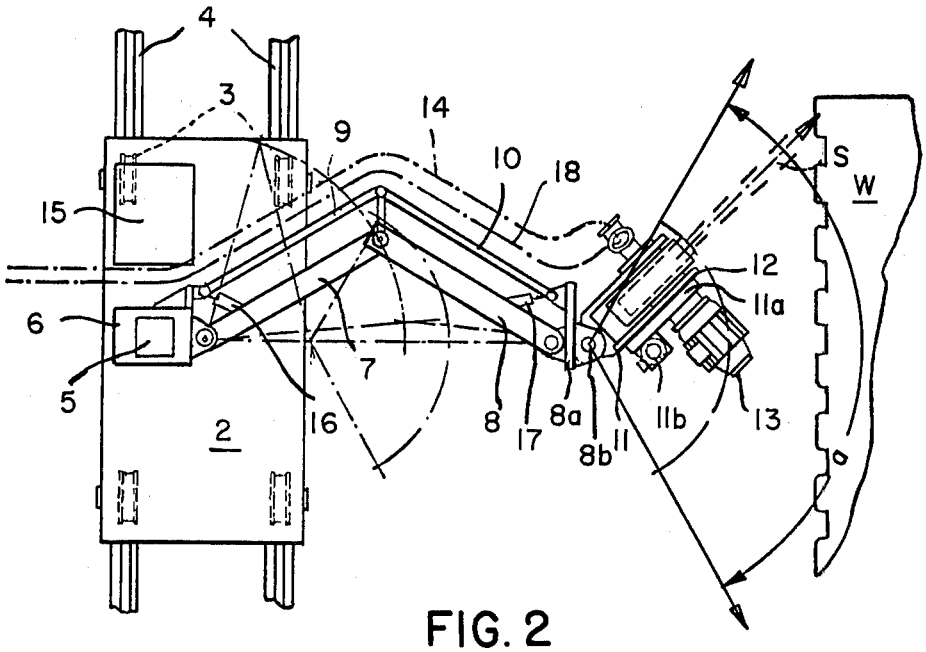
FIG. 2 is a schematic top plan view of the apparatus shown in FIG. 1.

By virtue of the construction and arrangement described, the centrifugal impeller or blasting wheel 12 can be pivoted or tilted in vertical and horizontal planes as shown by the lines *b* and *a* in FIGS. 1 and 2, respectively. The arm sections 7 and 8 similarly can be moved according to the phantom lines associated with them in the drawings. Also, the particulate material can be discharged from the centrifugal impeller in the path indicated by the letter S.

I claim:

1. Apparatus for blasting particulate material onto workpieces comprising an enclosure within which a workpiece can be positioned, said enclosure having a bottom wall with horizontally disposed rails thereon extending the length of the enclosure, a centrifugal impeller for blasting particulate material onto a workpiece in said enclosure, impeller mounting means including a carriage arranged to travel the length of the enclosure on said rails, motor means mounted on said carriage for driving the carriage on said rails, a vertical column on said carriage, an acticulated arm means pivotally connected at one end to said column for pivotal movement in a horizontal plane and connected at the other end to said centrifugal impeller wheel for supporting the latter, said other end including joints for pivotal movement of said centrifugal impeller about horizontal and vertical axes, said articulated arm means being extensible and contractible for moving the centrifugal impeller laterally away from and toward said column, and means for actuating said articulated arm means and said joints for selectively moving said centrifugal impeller to selected positioning and directing it at selected angles with respect to the workpiece.

2. Apparatus according to claim 1, wherein said arm means is vertically adjustable on said vertical column.

3. Apparatus according to claim 2, wherein remote control means are operatively connected to said mounting means and said centrifugal impeller for actuating them from outside said enclosure.

* * * * *